US006170588B1

(12) United States Patent
Irino et al.

(10) Patent No.: US 6,170,588 B1
(45) **Date of Patent: *Jan. 9, 2001**

(54) REVOLVING CONSTRUCTION MACHINE

(75) Inventors: Teruo Irino; Takaharu Nishimura, both of Ishioka; Shinichiro Endo, Ibaraki-ken, all of (JP)

(73) Assignees: Hitachi Construction Machinery Co., Ltd., Tokyo; Hokuetsu Industries Co., Ltd., Niigata-ken, both of (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/086,566

(22) Filed: May 29, 1998

(30) Foreign Application Priority Data

Jun. 3, 1997 (JP) ..... 9-160509

(51) Int. Cl.[7] ..... B62D 23/00

(52) U.S. Cl. ..... 180/89.1; 180/89.12; 180/89.13; 180/327; 280/760

(58) Field of Search ..... 180/89.1, 89.12, 180/89, 89.13, 327; 280/760

(56) References Cited

U.S. PATENT DOCUMENTS 3,841,430 * 10/1974 Babbitt et al. ..... 180/89
3,982,601 * 9/1976 Williams ..... 180/89
4,240,648 12/1980 Starr .
4,322,107 * 3/1982 Ishizuka et al. ..... 180/89.11
4,616,872 * 10/1986 Akira et al. ..... 180/89.12 X
5,286,081 * 2/1994 Martin ..... 180/89.12 X

FOREIGN PATENT DOCUMENTS 311 082 4/1989 (EP) .
5-125743 5/1993 (JP) .
7-018701 1/1995 (JP) .
7-243223 9/1995 (JP) .

* cited by examiner

*Primary Examiner*—Lanna Mai
*Assistant Examiner*—Toan To
(74) *Attorney, Agent, or Firm*—Mattingly, Stanger & Malur

(57) ABSTRACT

A revolving construction machine includes a lower track structure, an upper revolving structure mounted on the lower track structure and a working device mounted to the front of the upper revolving structure. A floor panel portion is provided on the upper revolving structure. A walk-through passageway is defined by a left-hand floor panel portion, a left side portion of a cabin cover and a left-hand cover of an engine cover for allowing a person to walk through the construction machine in the front and rear directions by passing the left side of an operator's seat, the cabin cover and the engine cover.

5 Claims, 8 Drawing Sheets

REVOLVING CONSTRUCTION MACHINE

BACKGROUND OF THE INVENTION

1. Field of the Invention

The present invention relates to a revolving construction machine such as a hydraulic excavator, for example, and more particularly to a revolving construction machine being able to swing with a small swing radius.

2. Description of the Related Art

Generally, hydraulic excavators and so on are known as revolving construction machines. A hydraulic excavator is made up of a lower track structure, an upper revolving structure rotatably mounted on the lower track structure, and a working device attached to a front portion of the upper revolving structure.

The upper revolving structure is mainly constructed of a revolving frame having a skeleton structure, a counterweight disposed on a rear portion of the revolving frame to balance with the working device, an engine cover positioned in front of the counterweight to cover an engine mounted on the revolving frame, a floor panel positioned in front of the engine cover to cover an upper surface of the revolving frame, and an operator's seat positioned in front of the engine cover and mounted on the floor panel. The working device is mounted to a front portion of the revolving frame.

Hydraulic excavators include revolving hydraulic excavators called the tail end small swing radius type and the minimal swing radius type (hereinafter referred to simply as small swing radius type hydraulic excavators). The small swing radius type hydraulic excavator is constructed such that when viewed from above, at least a portion of the upper revolving structure where the counterweight is positioned is substantially circular with respect to the center of rotation of the upper revolving structure, and when the upper revolving structure swings, at least the side of the counterweight is kept substantially within the track structure width. With that construction, the counterweight portion for which the operator has poor visibility from the operator's seat is able to swing substantially within the track structure width, and safety in work is ensured. According to descriptions, hydraulic excavators wherein a rear portion of an upper revolving structure projects beyond the track structure width until about 20% thereof, can be regarded as falling in the category of the tail end small swing radius type and the minimal swing radius type. Also, as for the term "within the track structure width", even if an upper revolving structure of a practical hydraulic excavator projects beyond the track structure width to some extent, such an upper revolving structure is also regarded as being substantially within the track structure width.

SUMMARY OF THE INVENTION

Meanwhile, the conventional small swing radius type hydraulic excavator stated above is frequently employed to carry out work in a narrow work site and an obstacle such as a wall is often closely present on the left side of the hydraulic excavator. In such a work site, the upper revolving structure and the wall are so close to each other that it is difficult for the operator to board on or alight from the operator's seat. Also, when walls are present on both sides of the hydraulic excavator, there arises a problem that a person cannot pass through the work site in the longitudinal direction of the hydraulic excavator.

In a hydraulic excavator of the cabin type that the operator's seat is covered by a cabin cover, the operator has to go in or out of the cabin cover by opening a door provided in the cabin cover. If the cabin cover is positioned close to the wall, the door cannot be fully opened. This raises a problem that each time the operator boards on or alights from the operator's seat, he has to take such an additional care of moving the hydraulic excavator to a place having a wide space; hence working efficiency deteriorates.

Another problem is that when the operator goes in or out of the cabin cover, the door is more likely to hit against the wall and is susceptible to damage in spite of the door being opened a little or not fully.

It would be conceivable that the door provided in the cabin cover could be fully opened by designing the radius of swing of the upper revolving structure to be much smaller than the width of the lower track structure. That design however accompanies a problem that the upper revolving structure is greatly reduced in size, apparatus and devices must be arranged in a cramped space, and working capability is deteriorated.

In view of the above-mentioned problems in the related art, an object of the present invention is to provide a revolving construction machine which allows the operator to easily board on or alight from an operator's seat even in a narrow work site, and improves working efficiency.

Note that the terms "front and rear" and "right and left" used in the specification mean the direction or side with respect to the operator sitting on an operator's seat, respectively.

A revolving construction machine according to the present invention comprises a lower track structure, an upper revolving structure rotatably mounted on the lower track structure, and a working device attached to a front portion of the upper revolving structure.

To achieve the above object, in accordance with the present invention, the upper revolving structure comprises a revolving frame having a skeleton structure, a counterweight disposed on a rear portion of the revolving frame to balance with the working device, an engine cover positioned in front of the counterweight to cover an engine mounted on the revolving frame, a side cover portion provided as part of the engine cover to extend in a front and rear direction on one of right and left sides of the upper revolving structure, a floor panel covering an upper surface of the revolving frame from the front side of the engine cover to a side of the side cover portion, an operator's seat positioned in front of the engine cover and mounted on the floor panel, and a walk-through passageway defined by the side cover portion of the engine cover and a floor panel side portion of the floor panel positioned laterally of the side cover portion for allowing a person to walk through the construction machine in the front and rear direction by passing a space laterally of the operator's seat and the engine cover.

By so constructing the upper revolving structure, even in the case of, e.g., carrying out work along a wall or parking a construction machine along a wall, since the walk-through passageway is left laterally of the operator's seat and the side cover portion of the engine cover relative to the wall, the operator can board on or alight from the operator's seat and walk through the construction machine in the front and rear direction by passing the walk-through passageway. In a construction machine of the cabin type that the operator's seat is covered by a cabin cover, particularly, a door can be opened within the walk-through passageway to such an extent allowing the operator to get on or off the cabin cover even in a narrow work site.

Preferably, a front end of a portion of the upper revolving structure at the floor panel side portion defining the walk-through passageway, where the revolving frame is positioned, is formed to have a corner portion radially projecting beyond a swing radius defined on the basis of an outer periphery of the counterweight.

With that feature, when going to swing the upper revolving structure, the operator can perform the operation while surely avoiding the counterweight portion, for which the operator has poor visibility, from contacting any surrounding obstacle such as a wall just by viewing from the operator's seat the corner portion of the front end of the upper revolving structure where the revolving frame is positioned and confirming that the corner portion does not contact the obstacle, even if the counterweight portion is sized to project beyond the track structure width to some extent.

Preferably, a handrail is provided on the floor panel side portion defining the walk-through passageway. With that feature, the operator can safely get on or off the walk-through passageway while gripping the handrail. In addition, spare parts, a fuel resupply tank, etc. placed on the floor panel side portion defining the walk-through passageway can be fixedly tied to the handrail and carried with the construction machine.

Preferably, a fuel resupply port is formed in the side cover portion of the engine cover at a position above the floor panel side portion defining the walk-through passageway.

With that feature, since a fuel resupply tank can be placed on the floor panel side portion defining the walk-through passageway at the time of resupplying fuel, fuel in the resupply tank can be poured through the fuel resupply port formed in the side cover portion of the engine cover while the resupply tank is kept placed on the floor panel side portion.

Furthermore, preferably, the revolving construction machine further comprises a cabin cover for covering the operator's seat, the cabin cover has a side portion extending substantially flush with the side cover portion of the engine cover, and the walk-through passageway is defined by the floor panel side portion, the side cover portion, and the side portion of the cabin cover.

DESCRIPTION OF THE PREFERRED EMBODIMENTS

A small swing radius type hydraulic excavator will be described hereunder in detail with reference to the accompanying drawings as one example of a revolving construction machine according to an embodiment of the present invention.

Figure 1:
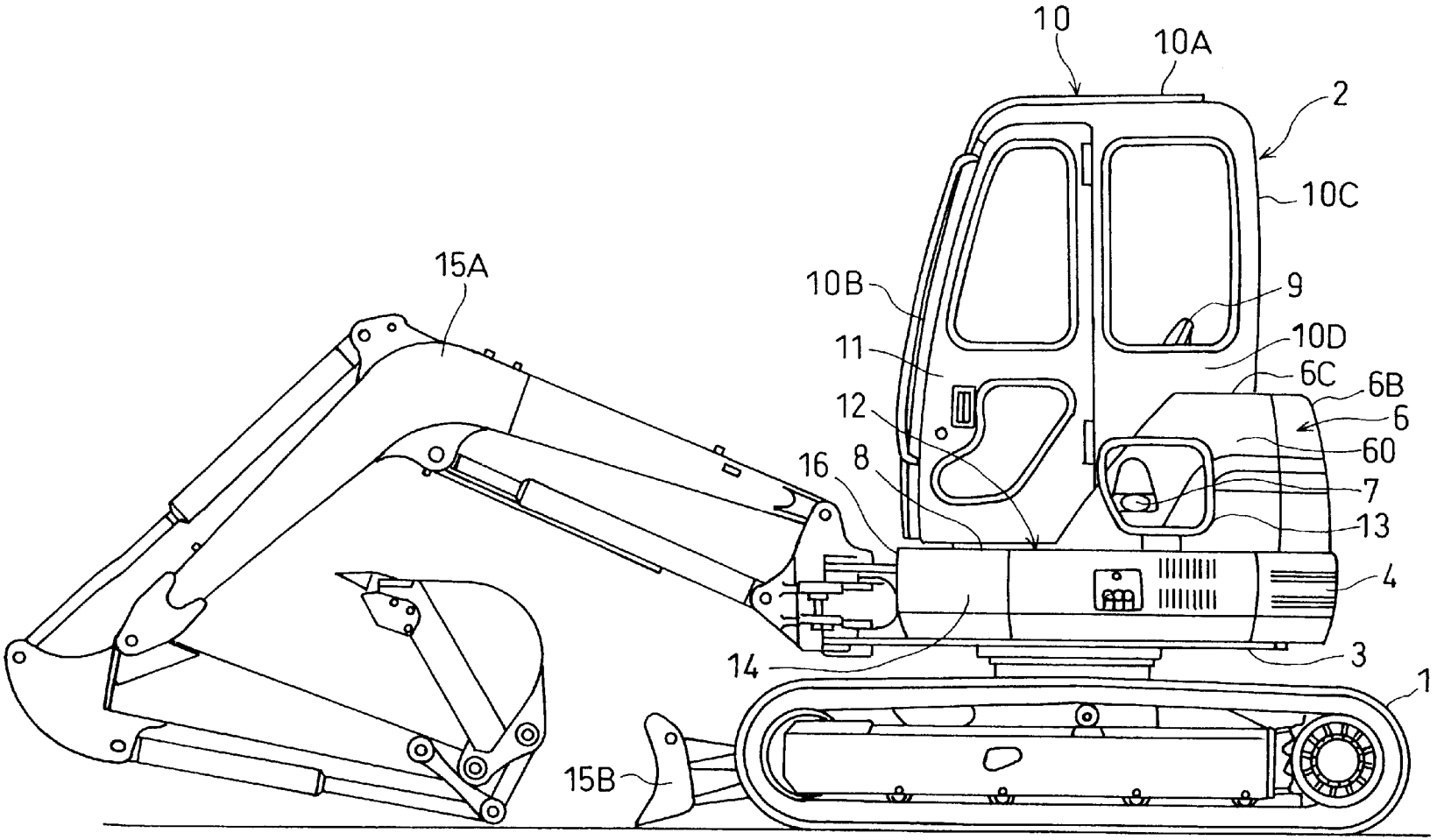
FIG. 1 is a front view of a hydraulic excavator according to a first embodiment of the present invention.
Figure 2:
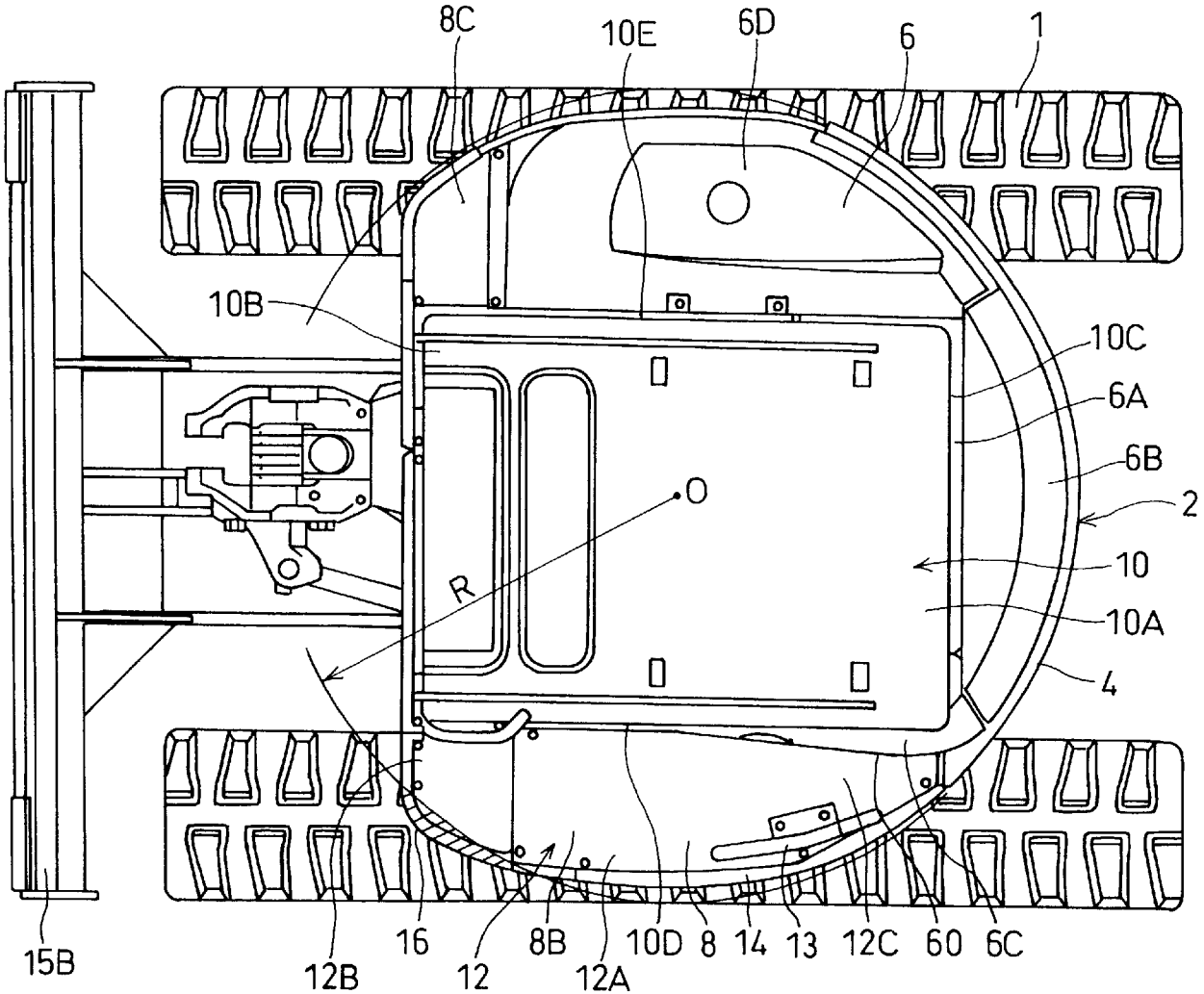
FIG. 2 is a plan view of the hydraulic excavator in enlarged scale.

FIGS. 1 to 6 show a first embodiment of the present invention. In the drawings, denoted by 1 is a lower track structure and 2 is an upper revolving structure rotatably mounted on the lower track structure 1. The upper revolving structure 2 is mainly made up of a revolving frame 3, a counterweight 4, an engine cover 6, a floor panel 8, a cabin cover 10 including an operator's seat 9, a walk-through passageway 12, etc., described later in detail, which cooperatively define an outer configuration of the upper revolving structure 2. A portion of the upper revolving structure 2 where the revolving frame 3 and the counterweight 4 are positioned is substantially circular with respect to the center 0 of rotation when viewed from above, as shown in FIG. 2.

Figure 3:
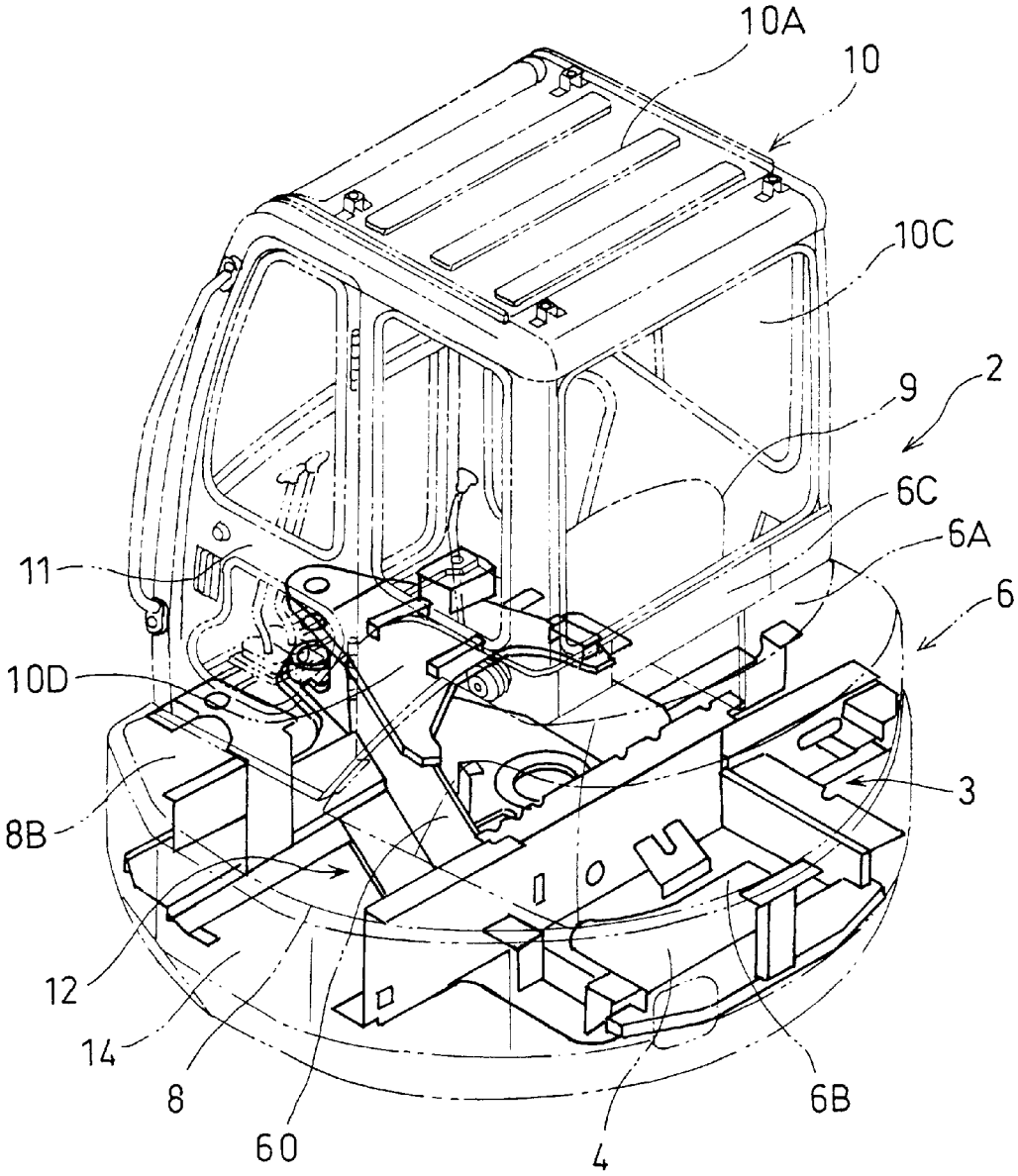
FIG. 3 is a see-through view of part of the hydraulic excavator as viewed from a position obliquely rearward above an upper revolving structure, the view showing the shapes of a revolving frame and the upper revolving structure.

Denoted by 3 is the revolving frame constituting a base portion of the upper revolving structure 2. The revolving frame 3 has a skeleton structure constructed, as shown in FIG. 3, by fixedly joining steel plates together by welding which are cut into predetermined shapes.

Denoted by 4 is the counterweight attached on a rear portion of the revolving frame 3 and formed to have an outer surface along an arc of a radius R about the center 0 of rotation (i.e., a swing radius R). The counterweight 4 serves to balance with a working device 15. Further, the counterweight 4 defines an outer peripheral profile of the base portion of the upper revolving structure 2 in cooperation with a lower cover 14, described later, which covers side and front surfaces of the revolving frame 3.

Denoted by 5 is an engine (indicated by dotted lines in FIG. 4) mounted on the revolving frame 3 and positioned in front of the counterweight 4. The engine 5 is mounted in a laterally-oriented condition to extend in a right and left direction. A hydraulic pump (not shown) driven by the engine 5 for delivering a hydraulic fluid, etc. are associated with the engine 5.

Denoted by 6 is the engine cover provided above a rear portion of the revolving frame 3. The engine cover 6 is mainly made up of a back cover 6A provided on the back side of the operator's seat 9, a rear cover 6B positioned rearward of the back cover 6A above the counterweight 4 so as to be able to open and close and usually called a bonnet, a left-hand cover 6C provided on the left side of the back cover 6A and the rear cover 6B, and a right-hand cover 6D provided on the right side of the back cover 6A and the rear cover 6B. The engine cover 6 covers the engine 5, etc. in cooperation with the counterweight 4. The rear cover 6B and the right-hand cover 6D are formed to have arc-shaped side surfaces which are rising upward from positions adjacent to the outer peripheral profile of the base portion of the upper revolving structure 2, whereas the left-hand cover 6C is formed to have a substantially flat side surface 60 which extends in a front and rear direction and rising upward from a position spaced from the outer peripheral profile of the base portion of the upper revolving structure 2. A fuel supply port 7 through which fuel is supplied to a fuel tank (not shown) is formed in the side surface 60 of the left-hand cover 6C.

Denoted by 8 is the floor panel (shown at a hatched area in FIG. 4) provided so as to cover an upper surface of the revolving frame 3 from the front side to the left side of the engine cover 6. As shown in FIG. 5, the floor panel 8 is formed substantially flat in its entirety.

Figure 4:
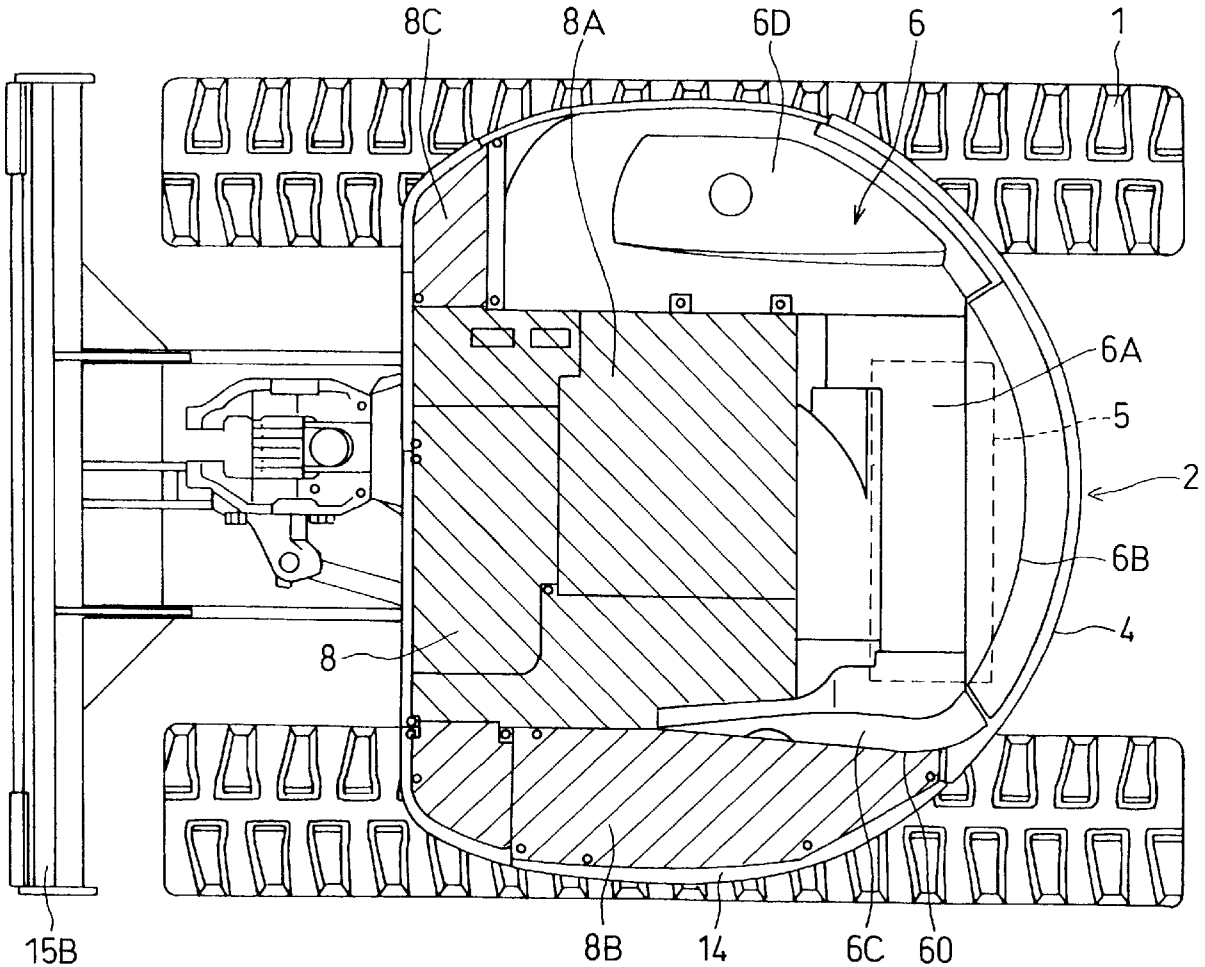
FIG. 4 is a plan view of the hydraulic excavator with an operator's seat, a cabin cover and so on omitted, the view showing the shape of a floor panel.
Figure 5:
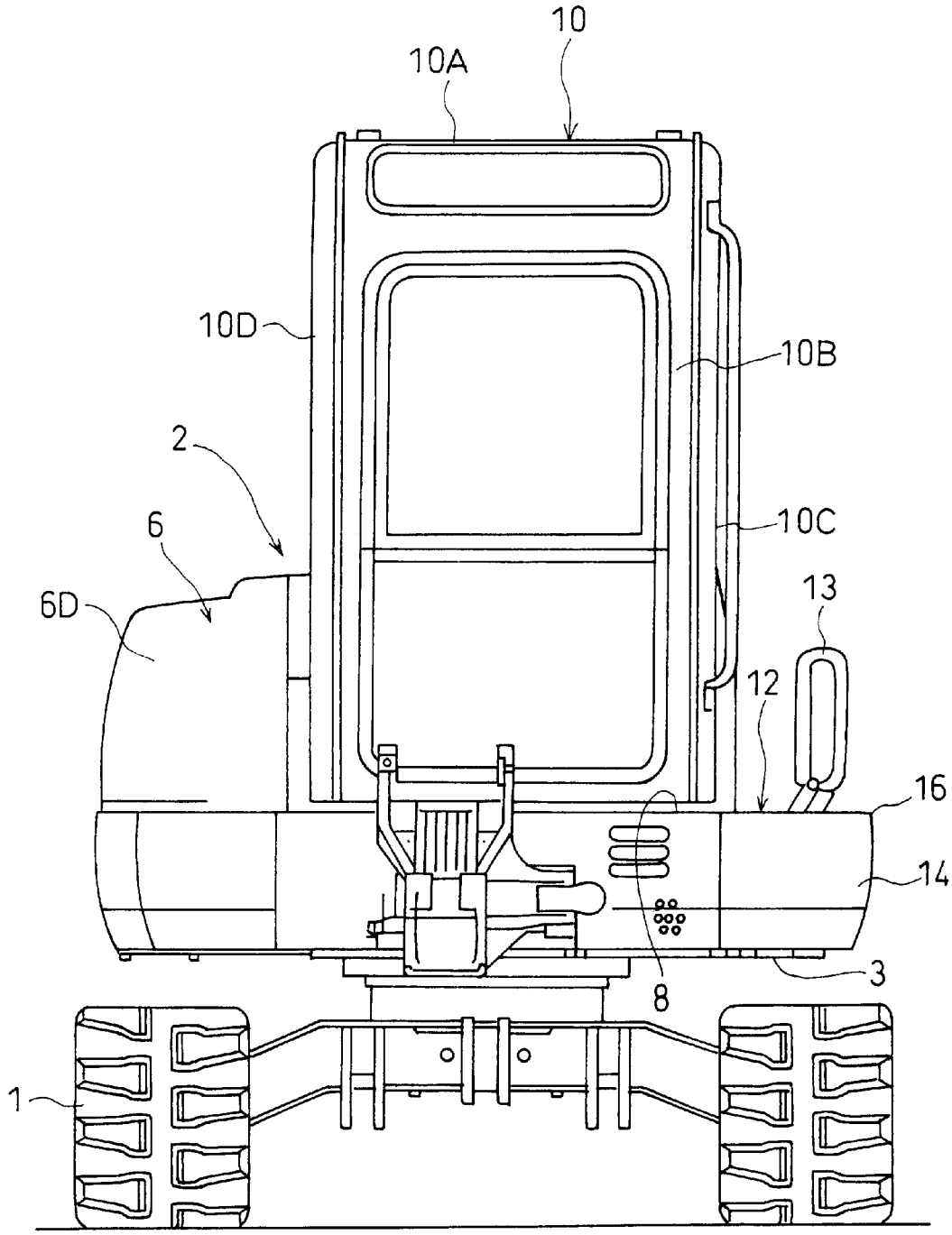
FIG. 5 is a left side view of a lower track structure and the upper revolving structure in an enlarged scale.

The floor panel 8 is made up of, as shown in FIG. 4, a central floor panel portion 8A positioned in front of the back cover 6A of the engine cover 6, a left-hand floor panel portion 8B positioned leftward of the left-hand cover 6C of the engine cover 6 and formed to an arc-shaped outer periphery, and a right-hand floor panel portion 8C positioned in front of the right-hand cover 6D of the engine cover 6.

Denoted by 9 is the operator's seat positioned at substantially the center of the revolving frame 3 and mounted on the central floor panel portion 8A of the floor panel 8. The operator's seat 9 is positioned in front of the back cover 6A of the engine cover 6, and control levers (not shown), etc. for operating the lower track structure 1 and the working devices 15A and 15B are disposed around the operator's seat 9.

Denoted by 10 is the cabin cover attached to the central floor panel portion 8A of the floor panel 8 so as to cover the operator's seat 9. The cabin cover 10 is in the form of a vertically elongated box comprising a ceiling portion 10A, a front surface portion 10B, a rear surface portion 10C, a left side portion 10D, and a right side portion 10E. The cabin cover 10 is provided with a door 11 positioned in the left side portion 10D and being able to open and close so that the operator can get in and out of the cabin cover 10. Thus, the cabin cover 10 in this embodiment is formed as a small rectangular housing positioned at the middle of the upper revolving structure 2 in the right and left direction and extending in the front and rear direction. The left side portion 10D of the cabin cover 10 is extended in the longitudinal direction substantially flush with the side surface 60 of the left-hand cover 6C of the engine cover 6.

Denoted by 12 is the walk-through passageway defined by the left-hand floor panel portion 8B of the floor panel 8, the left side portion 10D of the cabin cover 10 and the side surface 60 of the left-hand cover 6C of the engine cover 6 for allowing a person to walk through the hydraulic excavator in the front and rear direction by passing the left side of the operator's seat 9 (the cabin cover 10) and the engine cover 6. The left-hand floor panel portion 8B as a main component of the walk-through passageway 12 is disposed to extend in the front and rear direction of the revolving frame 3 and has a configuration defined by a central flat area 12A positioned in a central portion, a trapezoidal flat area 12B positioned in a front portion, and a triangular flat area 12C positioned in a rear portion and gradually narrowed rearwardly. The left-hand floor panel portion 8B has an enough width as a whole for a person to walk through the hydraulic excavator in the front and rear direction of the revolving frame 3.

The trapezoidal flat area 12B is positioned in the front portion of the walk-through passageway 12 and comprises a trapezoidal flat panel as a separate member from the other areas 12A and 12C whereby the area 12B constitutes a boarding/alighting step on which the operator or any other person can surely tread when going to get on or off the walk-through passageway 12.

Denoted by 13 is a handrail provided in the rear triangular flat area 12C of the left-hand floor panel portion 8B defining the walk-through passageway 12. The handrail 13 is gripped by the operator or any other person who is going to get on or off the left-hand floor panel portion 8B defining the walk-through passageway 12. As additional usage of the handrail 13, spare parts, a resupply tank including fuel therein, etc. (not shown), which are usually often placed on the left-hand floor panel portion 8B defining the walk-through passageway 12, can be fixedly tied to the handrail 13 with strings (not shown). Incidentally, the fuel supply port 7 formed in the side surface 60 of the left-hand cover 6C is located above the left-hand floor panel portion 8B defining the walk-through passageway 12.

Denoted by 14 is a lower cover provided so as to cover side and front surfaces of the revolving frame 3. Part of the lower cover 14 is positioned in overlapped relation to outer peripheral edges of the floor panel 8.

Denoted by 15A, 15B are working devices (see FIG. 1) attached to the front portion of the upper revolving structure 2. The working device 15A is attached to the front portion of the revolving frame 3 to be rotatable in the vertical and lateral directions for carrying out, e.g., work of excavating earth and sand.

Further, as shown in FIG. 2, the upper revolving structure 2 employed in this embodiment has a projecting corner portion 16 (indicated by a hatched area in FIG. 2) in a left front end thereof at a portion of the left-hand floor panel portion 8B defining the walk-through passageway 12 where the lower cover 14 of the revolving frame 3 is positioned. The projecting corner portion 16 is radially projected beyond the swing radius R defined on the basis of the outer periphery of the counterweight 4. This enables the operator to operate the hydraulic excavator while surely avoiding the portion of the counterweight 4, for which the operator has poor visibility from the operator's seat 9, from contacting any surrounding obstacle when the upper revolving structure 2 swings, by visually confirming that the projecting corner portion 16 does not contact the obstacle, even if the outer periphery of the counterweight 4 has such a size as projecting from the track structure width (i.e., the width of the lower track structure 1) to some extent. In addition, with that construction, a position for attachment of the trapezoidal flat panel of the trapezoidal flat area 12B is secured in the front portion of the walk-through passageway 12.

The small swing radius type hydraulic excavator of this embodiment has the above-explained construction and operates as follows.

First, when boarding on the hydraulic excavator, the operator standing on the lower track structure 1 gets on the left-hand floor panel portion 8B defining the walk-through passageway 12 while gripping the handrail 13, enters the cabin cover 10 after opening the door 11, and sits on the operator's seat 9.

Then, when the operator sitting on the operator's seat 9 operates the hydraulic excavator, the control levers are manipulated to supply and return the hydraulic fluid from the hydraulic pump, which is driven by the engine 5, to and from the lower track structure 1, whereupon the lower track structure 1 travels in a desired direction at a desired speed. Also, upon the hydraulic fluid from the hydraulic pump being supplied to the working device 15A or 15B, intended work such as excavation work, for example, is carried out.

Further, when going to swing the upper revolving structure 2, the operator can perform the operation while surely avoiding the counterweight 4, etc., for which the operator has poor visibility, from contacting any surrounding obstacle by viewing the projecting corner portion 16 positioned in the left front end of the upper revolving structure 2 and confirming that the projecting corner portion 16 does not contact the obstacle, even if the outer periphery of the counterweight 4 is projected beyond the track structure width to some extent.

Figure 6:
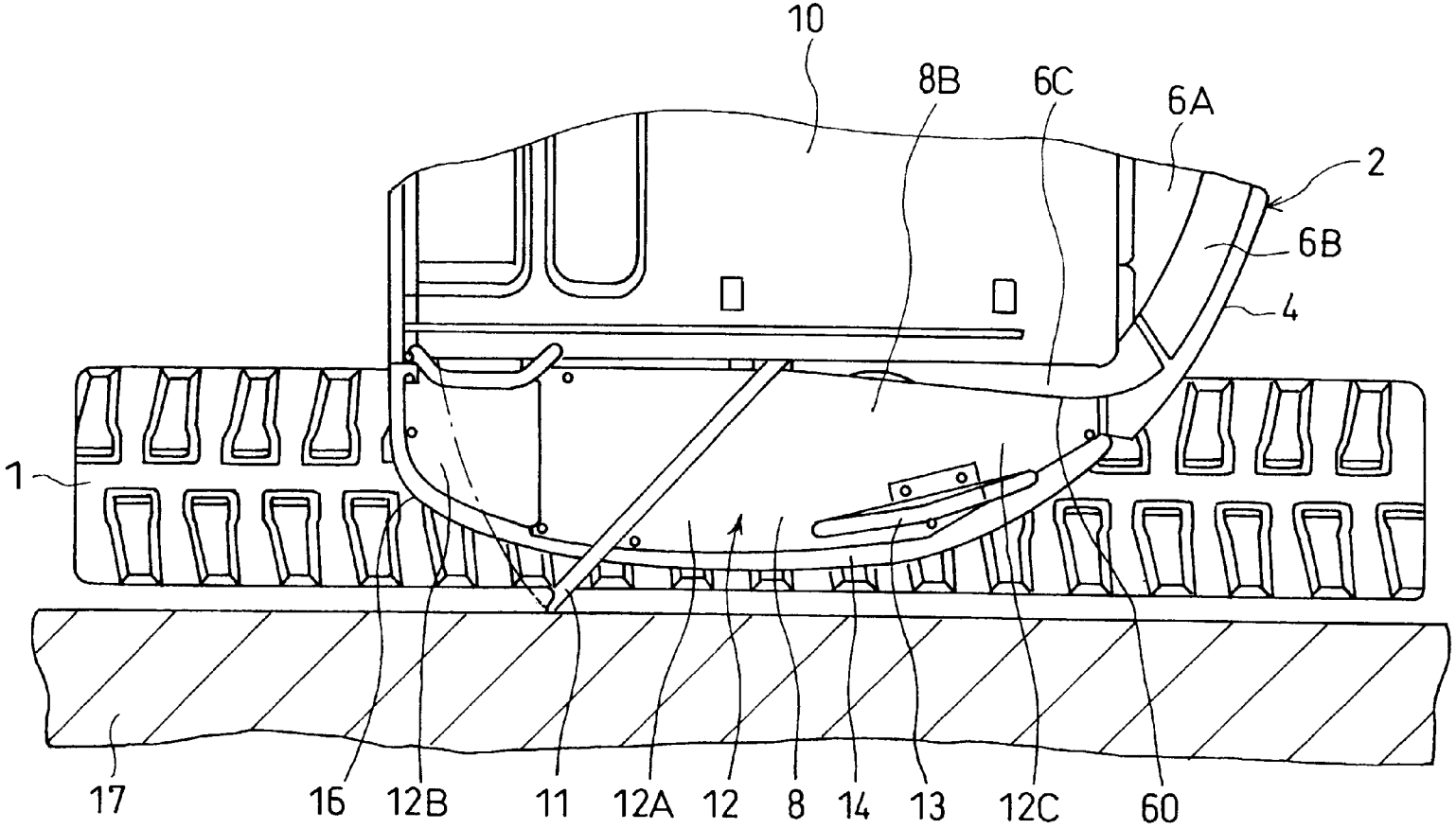
FIG. 6 is a plan view of part of the hydraulic excavator, in enlarged scale, located near a wall.

Meanwhile, the small swing radius type hydraulic excavator is often employed to carry out work in a narrow work site where an obstacle such as a wall 17 is present close to the lower track structure 1, as shown in FIG. 6. With this embodiment, even in such a narrow work site, a person can pass through the hydraulic excavator in the front and rear direction thereof by utilizing the walk-through passageway 12. Further, since the cabin cover 10 and the wall 17 are spaced from each other by the provision of the walk-through passageway 12, the door 11 can be opened within the walk-through passageway 12 to such an extent as allowing the operator to board on or alight from the operator's seat 9 in the cabin cover 10.

According to this embodiment, as explained above, since the walk-through passageway 12 is provided on the left side of the operator's seat 9 (the cabin cover 10) and the left-hand cover 6C of the engine cover 6, a person can walk through the upper revolving structure 2 in the front and rear direction even in a narrow work site by passing the walk-through passageway 12. Also, the operator can board on or alight from the operator's seat 9 by opening the door 11 within the walk-through passageway 12 without hitting the door 11 against the wall 17.

Accordingly, it is no longer required to move the hydraulic excavator each time a person is going to walk through the hydraulic excavator in the front and rear direction or the operator boards on or alights from the operator's seat 9, unlike the related art. Hence useless movement of the hydraulic excavator can be eliminated and working efficiency can be improved. Also, the hydraulic excavator can be parked close to another hydraulic excavator or the wall 17 or the like, and therefore a space necessary for parking the hydraulic excavator can be reduced. Further, since the door 11 can be opened by the presence of the walk-through passageway 12 without hitting the door 11 against the wall 17, there is no need of making the upper revolving structure 2 so small as to permit opening/closing of the door, resulting in that arrangement of apparatus and devices can be designed with high flexibility and working capability of the hydraulic excavator can be enhanced.

Since the front portion of the walk-through passageway 12 is constituted by the trapezoidal flat area 12B serving as the boarding/alighting step, the operator or any other person can surely tread on the trapezoidal flat area 12B when going to get on or off the walk-through passageway 12. This improves safety when the operator or any other person gets on or off the walk-through passageway 12.

When going to swing the upper revolving structure 2, the operator can perform the operation while surely avoiding the counterweight 4, etc., for which the operator has poor visibility, from contacting any surrounding obstacle just by viewing the projecting corner portion 16 of the upper revolving structure 2 and confirming that the projecting corner portion 16 does not contact the obstacle, even if the counterweight 4 is sized to project beyond the track structure width to some extent. As a result, efficiency and safety of the swing operation can be improved.

Since the handrail 13 is provided on the left-hand floor panel portion 8B defining the walk-through passageway 12, the operator can safely get on or off the walk-through passageway 12 while gripping the handrail 13. Further, since spare parts, a fuel resupply tank, etc. placed on the left-hand floor panel portion 8B can be fixedly tied to the handrail 13 with strings, those members can be carried with the hydraulic excavator.

Additionally, since the fuel supply port 7 is formed in the side surface 60 of the engine cover 6 at a position above the left-hand floor panel portion 8B defining the walk-through passageway 12, fuel can be resupplied while a resupply tank is kept placed on the floor panel side portion 8B, and therefore labor necessary for resupplying fuel can be lessened.

Figure 7:
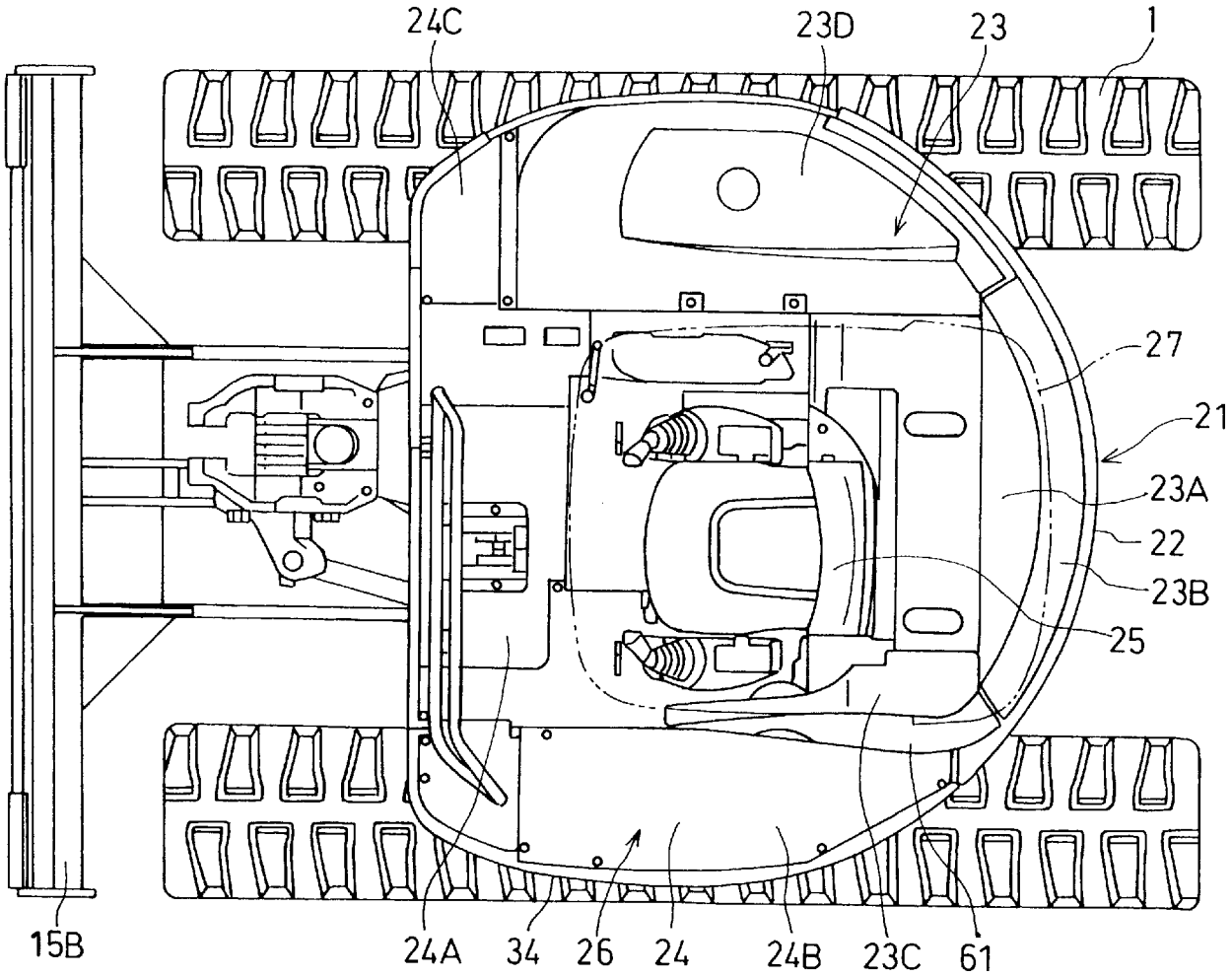
FIG. 7 is a plan view of a hydraulic excavator according to a second embodiment of the present invention.
Figure 8:
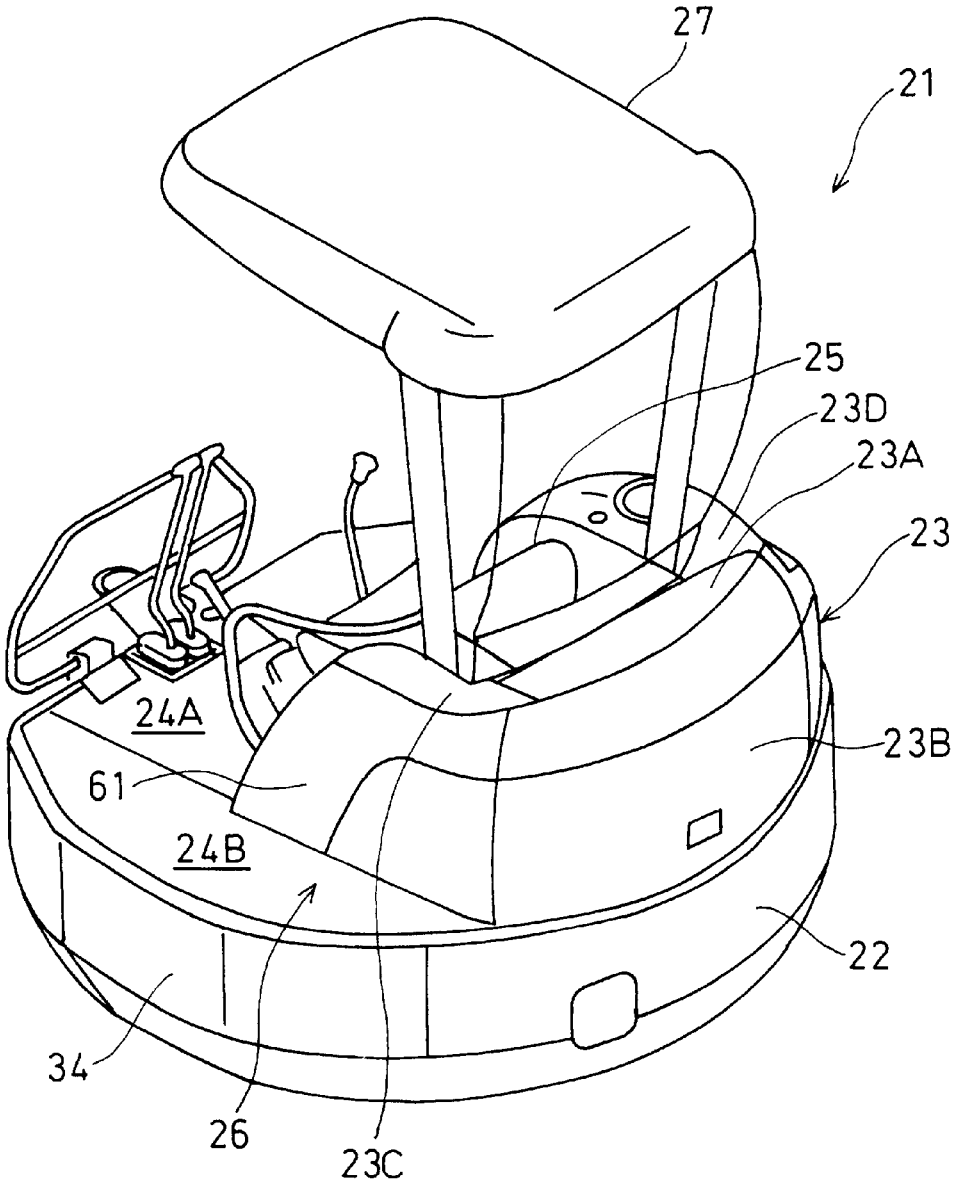
FIG. 8 is a perspective view of part of the hydraulic excavator in FIG. 7 as viewed from a position obliquely rearward above an upper revolving structure, the view showing the shape of the upper revolving structure.

FIGS. 7 and 8 show a second embodiment of the present invention. This second embodiment is featured in that the present invention is applied to a hydraulic excavator of the canopy type having a canopy provided to extend in covering relation to the operator's seat from above. Note that the same components in this embodiment as those in the above first embodiment are denoted by the same reference numerals and the description thereof is omitted here.

Denoted by 21 is an upper revolving structure used in this embodiment instead of the upper revolving structure 2 in the above first embodiment. The upper revolving structure 21 is mainly made up of a revolving frame (omitted), a counterweight 22 attached to the rear portion of the revolving frame, a lower cover 34 provided so as to cover side and front surfaces of the revolving frame and define an outer peripheral profile of a base portion of the upper revolving structure 21 in cooperation with the counterweight 22, an engine cover 23 positioned in a rear portion of the revolving frame and above the counterweight 22 so as to cover the engine 5 and comprising a back cover 23A, a rear cover 23B, a left-hand cover 23C and a right-hand cover 23D, a floor panel 24 covering an upper surface of the revolving frame from the front side to the left side of the engine cover 23 and comprising a central floor panel portion 24A, a left-hand floor panel portion 24B and a right-hand floor panel portion 24C, an operator's seat 25 positioned in front of the back cover 23A of the engine cover 23 and provided on the central floor panel portion 24A of the floor panel 24, and a walk-through passageway 26 defined by the left-hand floor panel portion 24B of the floor panel 24 and a side surface 61 of the left-hand cover 23C of the engine cover 23 for allowing a person to walk through the hydraulic excavator in the front and rear direction by passing the left side of the operator's seat 25 and the engine cover 23. A canopy 27 is provided to extend in covering relation to the operator's seat 25 from above.

This second embodiment thus constructed can also provide basically similar operating effects as obtainable with the above first embodiment.

According to the present invention, as fully explained above, the following advantages are achieved. Even in the case of, e.g., carrying out work along a wall or parking a construction machine along a wall, since the walk-through passageway is left laterally of the operator's seat and the engine cover relative to the wall, the operator can board on or alight from the operator's seat and walk through the construction machine in the front and rear direction by passing the walk-through passageway. In a construction machine of the cabin type that the operator's seat is covered by a cabin cover, particularly, the door can be opened within the walk-through passageway to such an extent allowing the operator to get on or off the cabin cover even in a narrow work site. Since it is no longer required to move the construction machine each time the operator boards on or alights from the operator's seat, useless movement of the construction machine can be eliminated and working efficiency can be improved. Additionally, a space necessary for parking the construction machine can be reduced.

Also, when going to swing the upper revolving structure, the operator can perform the operation while surely avoiding the counterweight portion, for which the operator has poor visibility, from contacting any surrounding obstacle such as a wall just by viewing from the operator's seat a corner portion formed at the front end of a portion of the upper revolving structure at the floor panel side portion defining the walk-through passageway where the revolving frame is positioned and confirming that the corner portion does not contact the obstacle, even if the counterweight is sized to project beyond the track structure width to some extent. As a result, efficiency and safety of the swing operation can be improved.

Further, since a handrail is provided on the floor panel side portion defining the walk-through passageway, the operator can safely get on or off the walk-through passageway while gripping the handrail. In addition, spare parts, a fuel resupply tank, etc. placed on the floor panel side portion defining the walk-through passageway can be fixedly tied to the handrail and carried with the construction machine. Therefore, the operation of repairing parts or resupplying fuel can be performed in the work site.

Moreover, since a fuel resupply tank can be placed on the floor panel side portion defining the walk-through passageway at the time of resupplying fuel, fuel in the resupply tank can be poured through a fuel resupply port formed in the engine cover while the resupply tank is kept placed on the floor panel side portion. As a result, labor necessary for the operation of resupplying fuel can be lessened.

What is claimed is:

1. A revolving construction machine comprising a lower track structure, an upper revolving structure rotatably mounted on said lower track structure, and a working device attached to a front portion of said upper revolving structure, wherein:

said upper revolving structure comprises a revolving frame having a skeleton structure, a counterweight disposed on a rear portion of said revolving frame to balance with said working device, an engine cover positioned on a front side of said counterweight to cover an engine mounted on said revolving frame, a floor panel covering an upper surface of said revolving frame from a front side of said engine cover to a lateral side thereof, a side cover portion provided as part of said engine cover to extend in front and rear directions on one of right and left sides of said upper revolving structure upwardly from a portion of said floor panel spaced inwardly from an outer periphery of the upper revolving structure, a floor panel side portion provided as part of said floor panel and positioned laterally outwardly of said side cover portion, an operator's seat positioned on the front side of said engine cover and mounted on said floor panel, and a walk-through passageway defined at the outside of the side cover portion of said engine cover by said floor panel side portion and said side cover portion whereby a person may walk through said construction machine machine in the front and rear directions by passing laterally outwardly of said operator's seat and said engine cover.

2. A revolving construction machine according to claim 1, wherein a front end of a portion of said upper revolving structure at said floor panel side portion defining said walk-through passageway, where said revolving frame is positioned, is formed to have a corner portion radially projecting beyond a swing radius defined on the basis of an outer periphery of said counterweight.

3. A revolving construction machine according to claim 1, wherein a handrail is provided on said floor panel side portion defining said walk-through passageway.

4. A revolving construction machine according to claim 1, wherein a fuel resupply port is formed in the side cover portion of said fuel engine cover at a position above said floor panel side portion defining said walk-through passageway.

5. A revolving construction machine according to claim 1, further comprising a cabin cover for covering said operator's seat, wherein said cabin cover has a side portion extending substantially flush with the side cover portion of said engine cover, and said walk-through passageway is defined at the outside of the side cover portion of said engine cover and the side portion of said cabin cover by said floor panel side portion, said side cover portion, and the side portion of said cabin cover.

* * * * *